US005615630A

United States Patent [19]

Eronen et al.

[11] Patent Number: 5,615,630

[45] Date of Patent: Apr. 1, 1997

[54] STERN ARRANGEMENT FOR A SHIP

[75] Inventors: Harri Eronen, Raisio; Arjo Harjula, Espoo, both of Finland

[73] Assignee: Finnyards Oy, Rauma, Finland

[21] Appl. No.: 454,229

[22] PCT Filed: Dec. 14, 1992

[86] PCT No.: PCT/FI92/00341

§ 371 Date: Jul. 31, 1995

§ 102(e) Date: Jul. 31, 1995

[87] PCT Pub. No.: WO94/13528

PCT Pub. Date: Jun. 23, 1994

[51] Int. Cl.[6] ..... B63B 21/04

[52] U.S. Cl. ..... 114/251; 114/253

[58] Field of Search ..... 114/218, 254, 114/251, 253, 242, 247, 248, 40, 41, 42, 43, 72, 270

[56] References Cited

U.S. PATENT DOCUMENTS

| | | | |
|---|---|---|---|
| 3,735,722 | 5/1973 | Hooper et al. | 114/249 |
| 3,866,555 | 2/1975 | Korkut | 114/270 |
| 3,892,386 | 7/1975 | Hogan | 114/254 |
| 3,977,352 | 8/1976 | Pran et al. | 114/72 |

*Primary Examiner*—Stephen Avila
*Attorney, Agent, or Firm*—Ronald J. Kubovcik

[57] ABSTRACT

A stern arrangement for a ship where the stern of the ship is made modifiable or convertible for at least two different purposes by moving or by replacing at least a part of the stern. The stern of the ship is convertible to be a towing notch or to be equipped with a stern roller. The invention provides an icebreaker which is equipped with a towing notch in wintertime and with a stern roller in the summertime for open water operations.

12 Claims, 7 Drawing Sheets

STERN ARRANGEMENT FOR A SHIP

The present invention relates to a stern arrangement for a ship.

BACKGROUND OF THE INVENTION

There are occasions when a ship is towed by another ship. Typically it happens when an icebreaker tows a ship. Towing by icebreaker must be done so that the bow of the ship to be towed has been pulled tightly into the close contact with the stern of the icebreaker. The ship to be towed will be kept in the right place by a towing winch located aboard on the icebreaker. The winch pulls strongly at the wire rope the bow of the towed ship against the stern of the icebreaker during the towing operation.

For towing purposes the stern of the icebreaker must be formed in a special way. At the stern of the icebreaker there is an inwards curved towing notch which makes possible to tow another vessel. Only when equipped with this notch it is possible for the icebreaker to tow a ship in the way that the bow of the ship to be towed is pressed directly towards the stern of the icebreaker.

There are also other kind of special needs for the stern form of a ship. In open water for example the anchor handling and the cable laying operations require different kind of stern forming. At the stern of a supply vessel there must not be any formed towing notches. Instead of that it is on the contrary required that the stern of the supply vessel is straight and the stern roller is installed. In the supply vessel the different kind of hoisting operations are done over the transom with a winch or crane.

The special requirements said above cause that a ship constructed for one purpose can not be used for another purpose. The same ship can not be used for the towing in winter and for supply operations in summer. The requirements for the stern shape and the stern structure are so different in winter operations and respectively in summer operations that it is not possible to build a fixed structure which would be suitable for the both purposes.

The problem with icebreakers, however, is their short operating time in winter. It should be able to use icebreakers also in the summertime in open water. Correspondingly the supply vessel can not be used for towing in wintertime because of its unsuitable stern construction.

SUMMARY OF THE INVENTION

The object of the present invention is to eliminate the above mentioned problem. This purpose will be achieved so that according to the invention the stern of the ship is made modifiable or convertible for at least two different purposes, by moving or by replacing at least a part of the stern.

PREFERRED EMBODIMENTS OF THE INVENTION

According to a preferred embodiment of the invention the stern of the ship is convertible to be a towing notch or to be equipped with a stern roller.

The preferred embodiment of the invention provides the ship which is equipped with a structure which enables a towing notch in wintertime and a stern roller in the summertime. Combining these two possibilities it is for the first time possible to make a multipurpose icebreaker which is suitable both for winter operations and also for summer operations.

Besides the supply operations in summer the suitable tasks for a multipurpose icebreaker would be for example towing, anchor handling, cable laying, flexible pipe laying and supply operations. These kind of operations are usually operated by a special supply ship which has the straight stern and which is also equipped with a stern roller. With a supply ship it is possible to do different kind of hoisting operations over the transom with a winch or crane. Typical operations are anchor handling and hoisting of umbilicals and other offshore equipments.

According to an embodiment of the invention at the stern of the ship there is at least one movable part which moves out in the way that a towing notch or a stern roller is available.

An other embodiment of the invention the stern of the ship is equipped either with a fixed towing notch or with a fixed stern roller section, and the other one of them is movable or removable in the way that the towing notch or the stern roller is available for use one at a time.

Still one embodiment of the invention is that the towing notch and the stern roller section are both removable, and at the stern of the ship there is a place where the towing notch or the stern roller can be installed one at a time.

The above and other features and advantages of this invention will become better understood by reference to the detailed description that follows, when considered in connection with the accompanying drawings.

DETAILED DESCRIPTION OF THE ILLUSTRATED EMBODIMENTS

Figure 1:
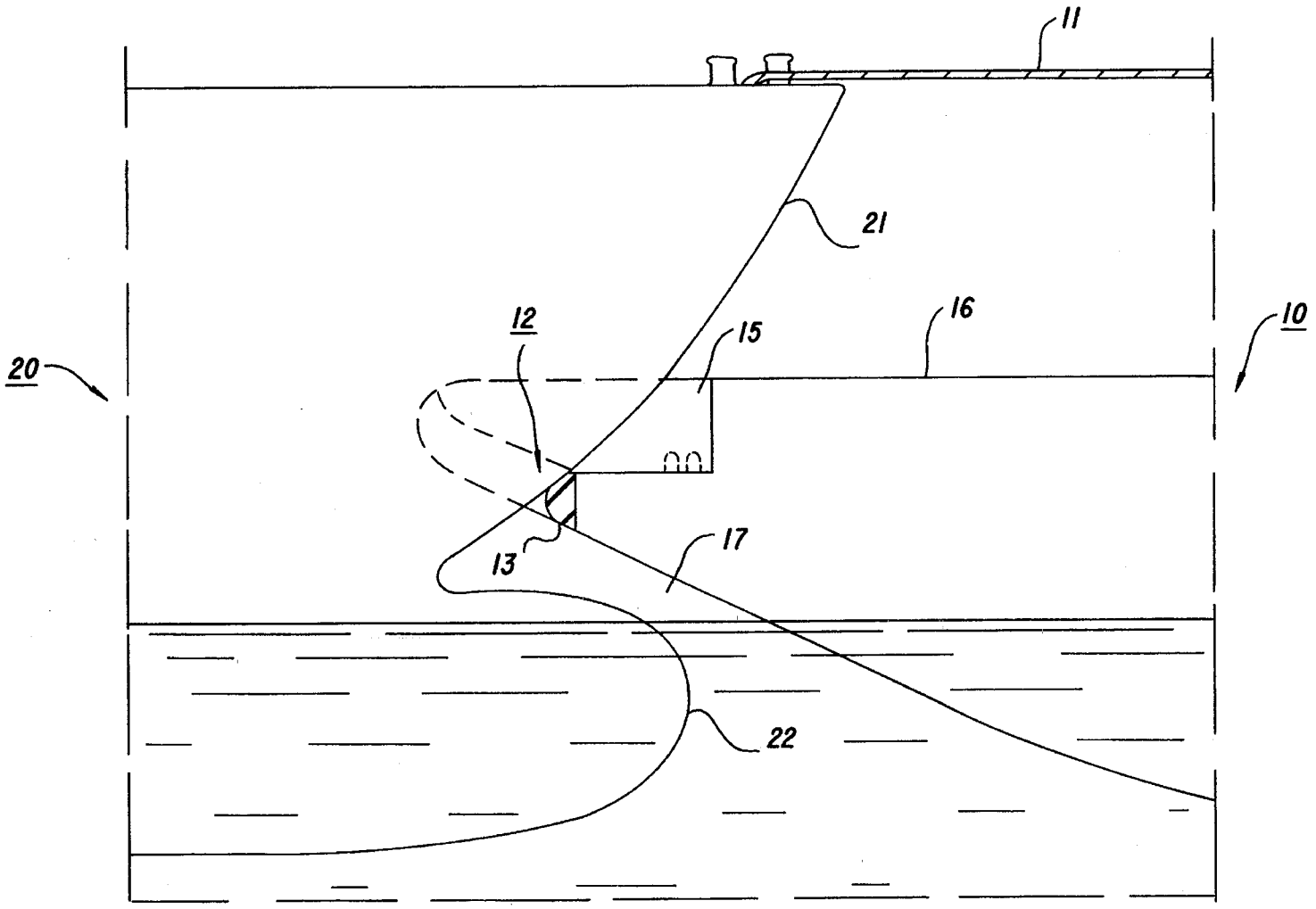
FIG. 1 is a schematic side view of the stern of the towing ship and the bow of the ship to be towed.

FIG. 1 is a schematic side view of the stern of the towing ship 10 and the bow of the ship 20 to be towed. In the FIG. 1 the bow 21 of the ship 20 has been drawn against the stern notch 12 of the ship 10 by pulling at the wire rope 11. In icebreaker use the towing notch 12 is equipped with rubber fenders 13 on both sides and a steel casting or a steel plate at the bottom of the notch 12.

The stern of the towing ship 10 in FIG. 1 has been formed in the way that the notch 12 is below the working deck level and that there is a clearance 15 between the aft deck 16 and the bow 21 of the ship 20 to be towed. If the towed ship 20 has a bulbous bow 22 there must also be a clearance 17 for that.

Figure 2:
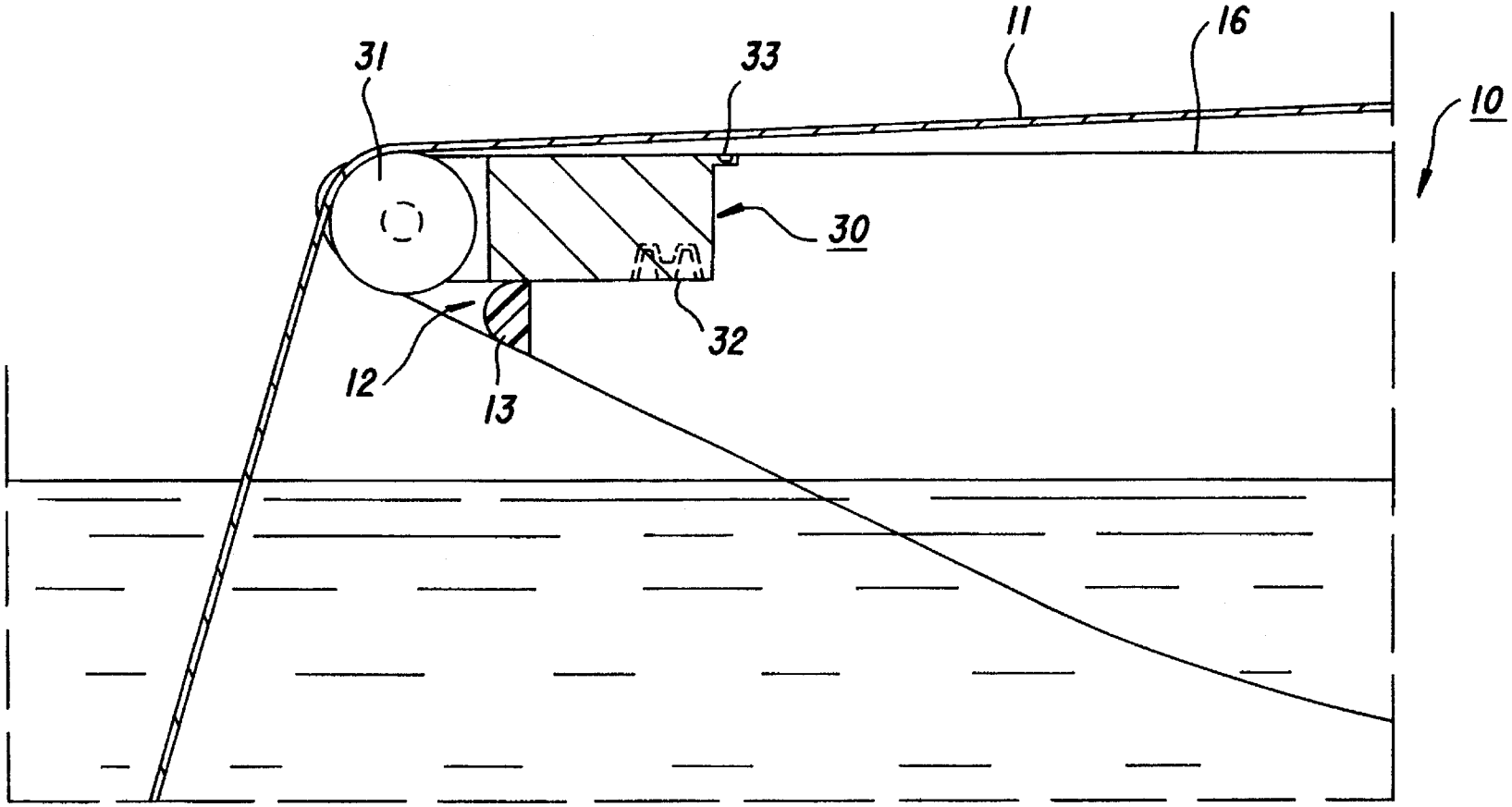
FIG. 2 is a schematic side view of the ship of FIG. 1 with the modified stern construction.

In FIG. 2 is a schematic side view of the ship 10 of FIG. 1 with the modified stern construction. Above the notch 12 in close contact there is a separate steel section 30 with a stern roller 31 added. The upper surface of the section 30 is fitted to be on the same level with the aft working deck 16 so that the section 30 and the deck 16 together form an ordinary looking supply ship stern. The wire rope 11 can now easily be used for hoisting and for anchor handling operations.

The section 30 has been built and reinforced according to the working deck load requirements. It can be lifted on its place for use in summer and removed again for wintertime. The joint of the stern section can be made by welding the section 30 to the aft working deck 16 or it can be attached by bolts 33. There may also be guide members 32 to help the installation of the section 30 and to help locking the section into its right place.

The notch 12 may also be a removable section instead of the roller section 30. In that case the roller section 30 may be formed to be a fixed part of the aft working deck. Still another embodiment of the ship is that the both sections are removable. Into the ship will then be installed the section which will be needed at that time.

Figure 3:
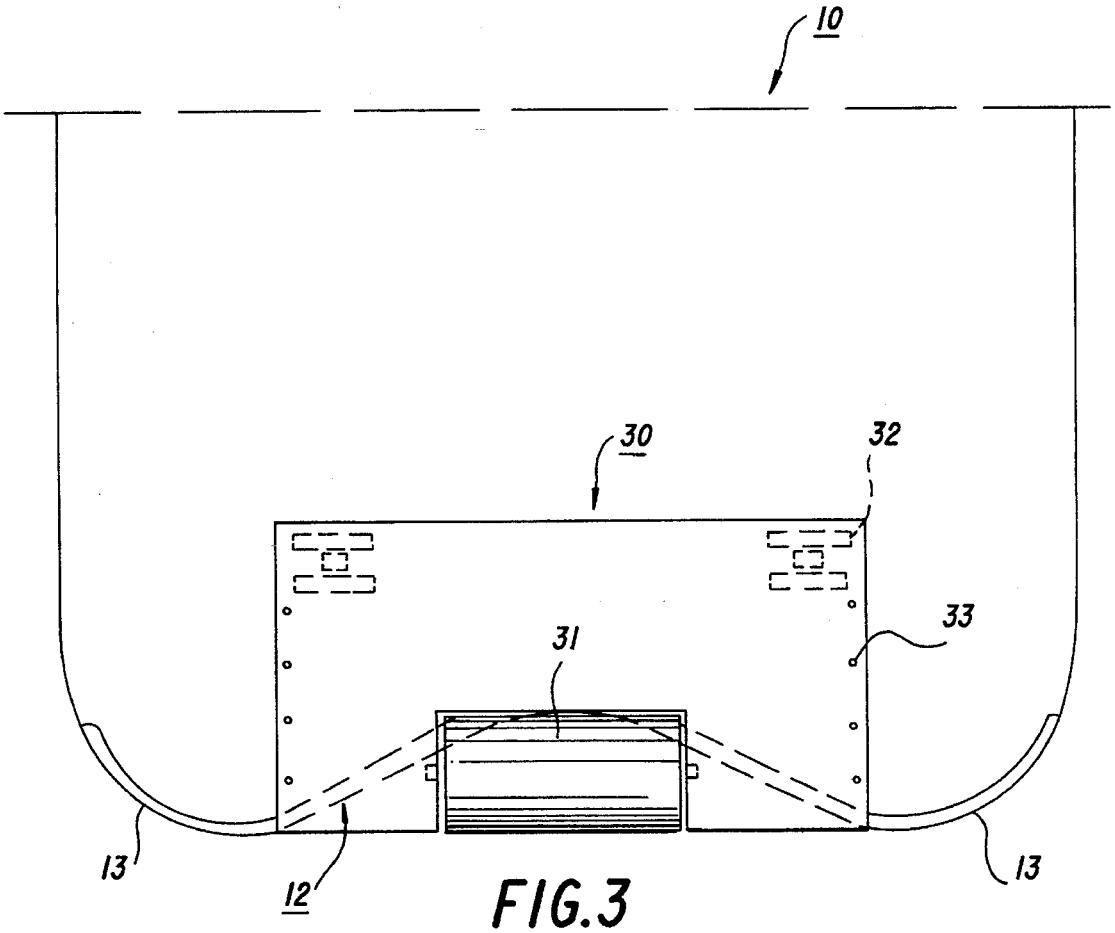
FIG. 3 is a top view of the stern of the ship of FIG. 3.

FIG. 3 is a top view of the stern of the ship 10 of FIG. 2. The section 30 with a stern roller 31 is installed to the stern of the icebreaker. The section 30 is located above the notch 12 so that the stern of the ship forms a straight line instead of the notch.

Alternatively the construction of FIG. 3 can also be arranged so that at the stern of the ship 10 there is only a place for an external section. Then depending of the needed operation either the notch section 12 or the stern roller section 30 will be selected and installed into that place.

This arrangement is suitable especially when the ship is so low that the notch section 12 and the stern roller section 30 can not be installed together one on the other. Also the stern roller 31 of very large diameter does not allow the roller section 30 and the notch 12 arrangement to be installed together at the same time.

The stern roller section 30 in FIG. 3 may also be narrower so that it covers only a part of the notch section 12. In that case the rubber fenders 13 extend further aft and a part of the notch will be seen together with the roller arrangement.

Figure 4:
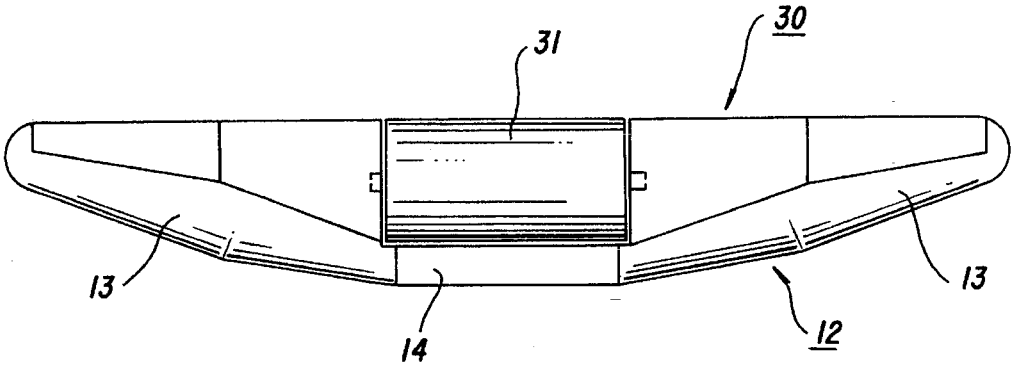
FIG. 4 is an aft view of the stern construction of the ship of FIG. 2.

FIG. 4 is an aft view of the stern construction of the ship 10 of FIG. 3. The removable section 30 with a roller 31 is installed to the stern of the icebreaker above the notch 12. The rubber fenders 13 of the towing notch 12 can be seen on both sides and also the steel casting or steel plate 14 at the bottom of the notch.

Figure 5:
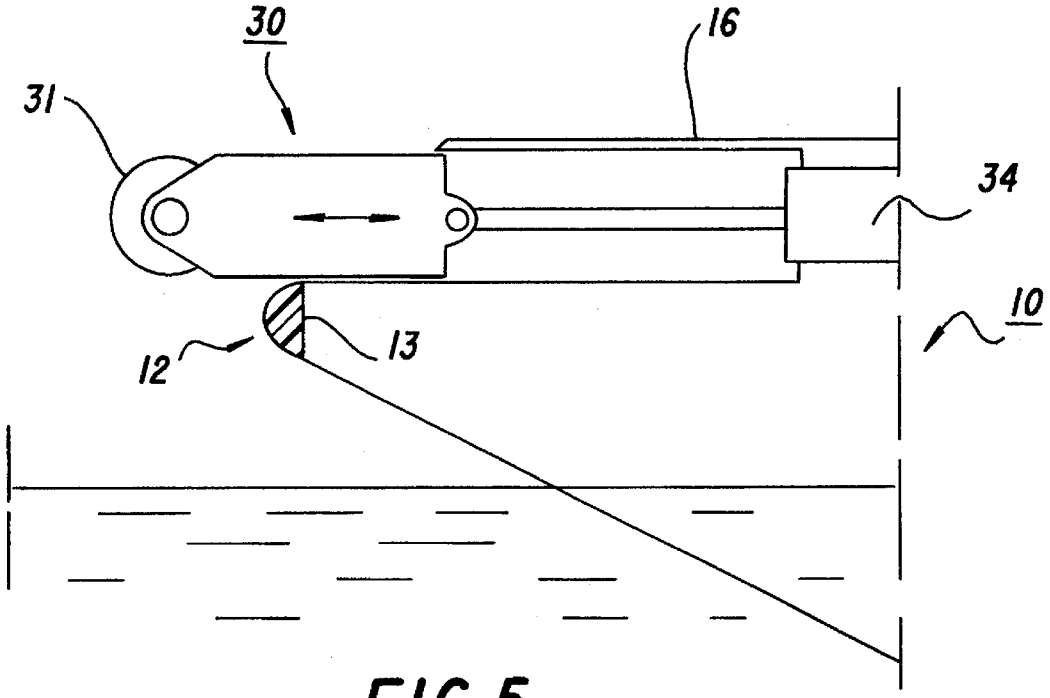
FIG. 5 is a side view of the stern construction of the ship of FIG. 2 according to the second embodiment.

FIG. 5 is a side view of the stern construction of the ship according to the second embodiment. The roller section 30 is provided with horizontal guide members and with a hydraulic cylinder 34. The cylinder 34 pushes the section 30 out when it will be needed and respectively pulls it back again below the aft deck 16 when the notch 12 is needed in icebreaker use.

Figure 6:
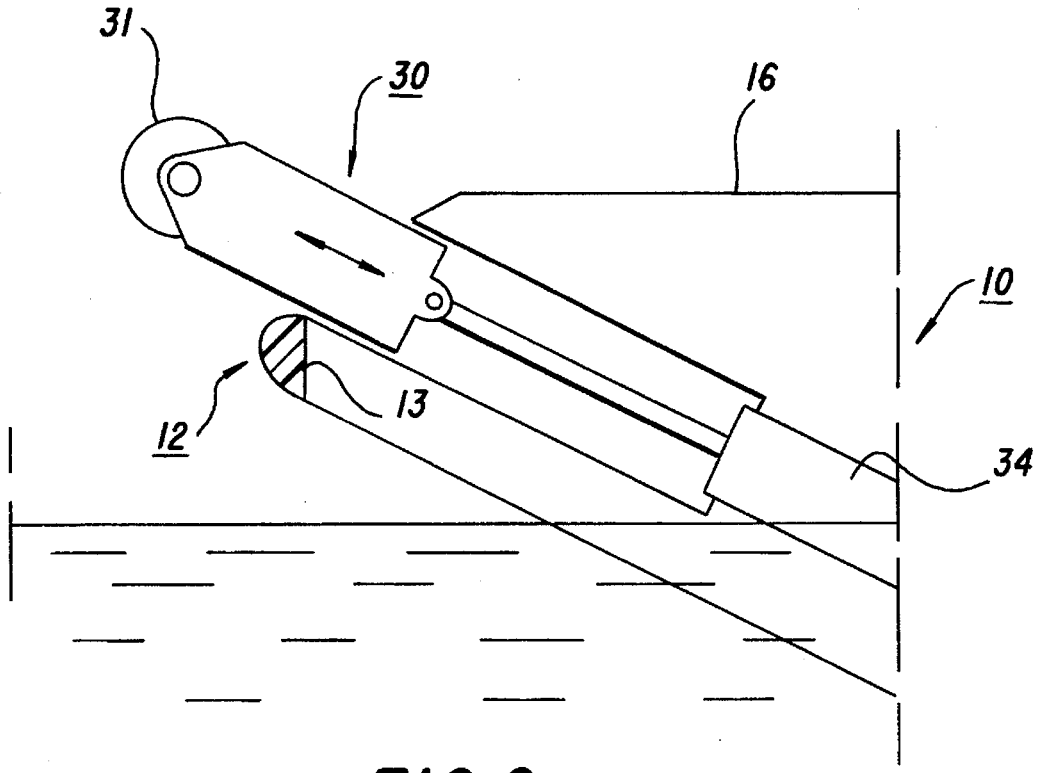
FIG. 6 is the stern construction of the ship of FIG. 2 according to the third embodiment.

In FIG. 6 is the third embodiment for the stern construction of the ship 10. The roller section 30 is provided with guide members and a hydraulic cylinder 34 which are lined together with the bottom line of the ship 10.

Figure 7:
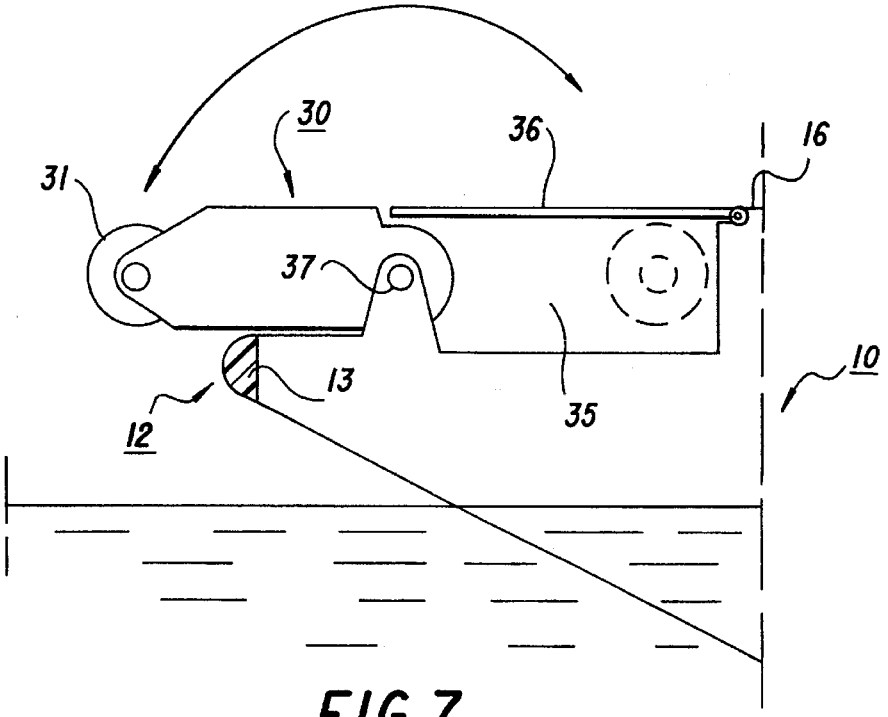
FIG. 7 is the stern construction of the ship of FIG. 2 according to the fourth embodiment.

FIG. 7 is the stern construction according to the fourth embodiment where the stern roller 31 section 30 can be turned to a store locker 35 while the vessel is used as an icebreaker. The store locker 35 is formed into the working deck 16 and it is provided with a cover 36.

Figure 8:
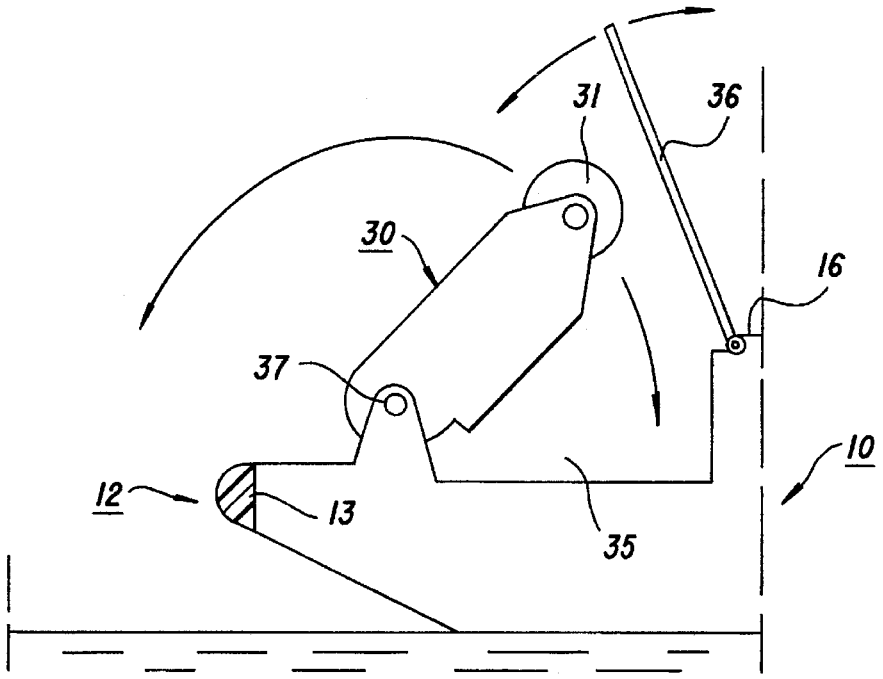
FIG. 8 shows the function of the stern construction of FIG. 7.

In FIG. 8 is presented the function of this stern construction of FIG. 7. The cover 36 has been opened and the section 30 will be turned around the axis 37 into the locker 35. When the roller section 30 is in the locker 35 and the cover 36 is closed the ship 10 can be used as an icebreaker.

Figure 9:
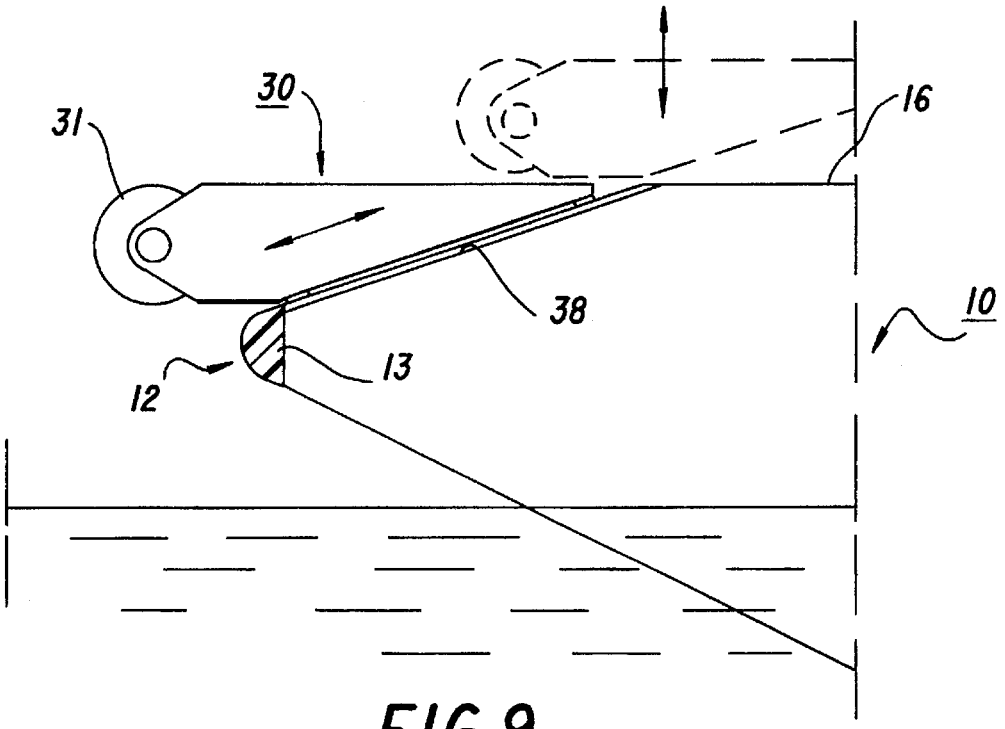
FIG. 9 is the stern construction of the ship of FIG. 2 according to the fifth embodiment.

FIG. 9 is the stern construction according to the fifth embodiment where the stern roller section 30 is located on rails 38. When the section 30 will be installed it will be lifted on the rails 38. After gliding along the rails 38 the section 30 will be stopped by the stoppers and the conical locking members will lock it into the place. There may also be bolts or hydraulic locking members at fore end of the rails 38.

Figure 10:
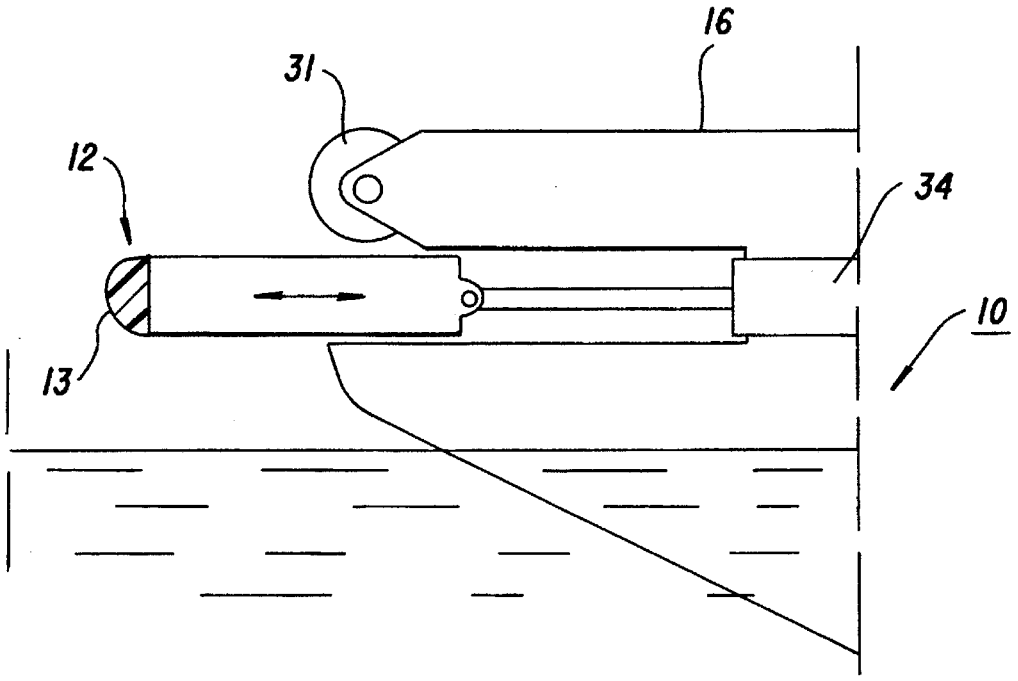
FIG. 10 is the stern construction of the ship of FIG. 2 according to the sixth embodiment.
Figure 11:
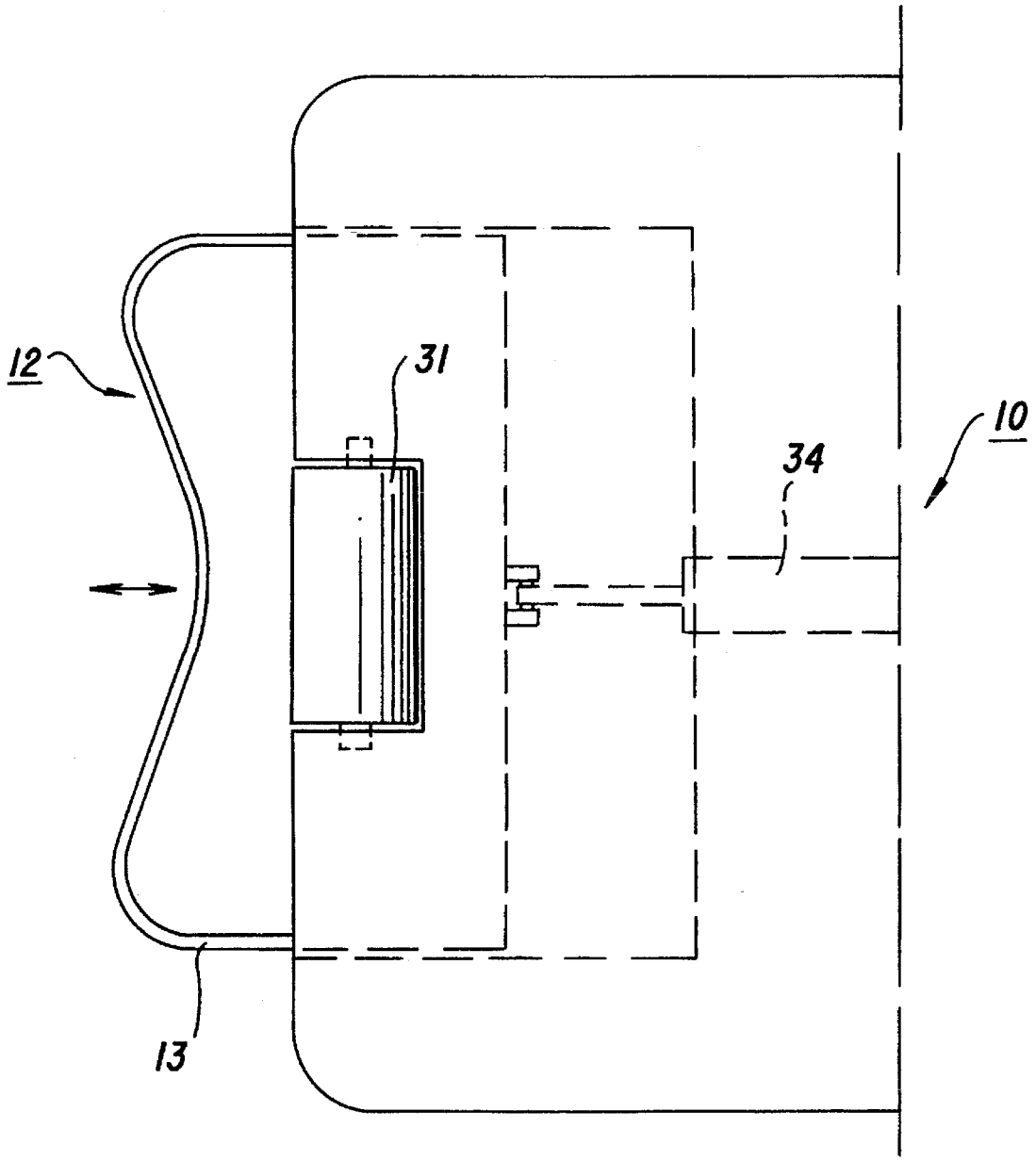
FIG. 11 is a top view of the stern construction of the ship of FIG. 10.

In FIG. 10 is the stern construction of the ship 10 where the notch section 12 is moving instead of the roller section 30. The notch 12 may be even removable but in this embodiment the stern roller 31 is fixed. The notch will be moved by a hydraulic cylinder 34. The final locking is made by hydraulic cylinders or preferably by bolts. FIG. 11 shows the top view of the same construction.

We claim:

1. A convertible stern arrangement for a ship comprising:

a stern;

an inwardly curved towing notch formed in said stern for receiving a bow of a ship to be towed;

a removable section disposed in said towing notch; and a stern roller for use in hoisting operations mounted on said removable section, whereby said stern is suitable for use in hoisting operations and can be converted for use in towing operations by removing said removable section.

2. The stern arrangement for a ship of claim 1, wherein the removable section fills in the towing notch such that the stern includes a substantially straight section.

3. The stern arrangement for a ship of claim 2, wherein the towing notch is below a level of a working deck and an upper surface of the removable section is at the level of the working deck.

4. A convertible stern arrangement for a ship comprising:

a stern;

an inwardly curved towing notch formed in said stern for receiving a bow of a ship to be towed;

a movable section disposed in said stern, said movable section being movable to fill in at least a portion of said towing notch; and a stern roller for use in hoisting operations mounted on said movable section, whereby said stern is suitable for use in towing operations and can be converted for use in hoisting operations by moving said movable section.

5. The stern arrangement for a ship of claim 4, wherein the movable section fills in the towing notch such that the stern includes a substantially straight section.

6. The stern arrangement for a ship of claim 4, wherein the movable section is disposed below a working deck when not in use.

7. The stern arrangement for a ship of claim 4, wherein the movable section is moved by a hydraulic cylinder.

8. The stern arrangement for a ship of claim 4, wherein a storage locker for storing the movable section when not in use is formed below the working deck, a cover for said locker is provided in the working deck, and the movable section is pivotally attached to a base so that the movable section can be swung into and out of said locker.

9. The stern arrangement for a ship of claim 4, wherein the movable section is mounted on rails.

10. A convertible stern arrangement for a ship comprising:

a stern having a substantially straight section;

a stern roller for use in hoisting operations fixedly mounted at said stern; and a movable section disposed in said stern, said movable section having an inwardly curved towing notch formed therein and being movable in a direction away from said stern so as to extend beyond said stern roller, whereby said stern is suitable for use in hoisting operations and can be converted for use in towing operations by moving said movable section.

11. The stern arrangement for a ship of claim 10, wherein the stern roller is mounted above the movable section.

12. The stern arrangement for a ship of claim 10, wherein the movable section is moved by a hydraulic cylinder.

* * * * *